United States Patent [19]

Ashizaki et al.

[11] Patent Number: 4,609,847

[45] Date of Patent: Sep. 2, 1986

[54] CATHODE RAY TUBE WITH MAGNETIC POLE PIECES WHICH SUPPORT A RING GETTER

[75] Inventors: Shigeya Ashizaki, Takatsuki; Masamichi Kimura, Ibaraki; Masato Taniguchi, Uji, all of Japan

[73] Assignee: Matsushita Electronics Corporation, Kadoma, Japan

[21] Appl. No.: 564,220

[22] Filed: Dec. 22, 1983

[30] Foreign Application Priority Data

Dec. 24, 1982 [JP] Japan ..... 57-234500

[51] Int. Cl.[4] ..... H01J 29/70; H01J 29/76; H01J 29/94

[52] U.S. Cl. ..... 313/413; 313/431; 313/481

[58] Field of Search ..... 313/413–414, 313/426, 431, 433, 481, 558, 559

[56] References Cited

U.S. PATENT DOCUMENTS

| | | | |
|---|---|---|---|
| 3,244,418 | 9/1966 | Crumly | 313/431 |
| 3,334,258 | 8/1967 | Kaplan et al. | 313/481 X |
| 4,057,747 | 11/1977 | Hamano | 313/413 |

*Primary Examiner*—Palmer C. DeMeo
*Assistant Examiner*—Sandra L. O'Shea
*Attorney, Agent, or Firm*—Cushman, Darby & Cushman

[57] ABSTRACT

In a deflection means 11 having a field of pin-cushion type flux distribution, at least a pair of T-shaped magnetic pole pieces 9, 10 are disposed between the front end of an electron gun 2 and the center part of the deflection means 11, thereby to form a barrel type flux distribution, to attain high resolution even at peripheral part of the fluorescent screen.

3 Claims, 7 Drawing Figures

CATHODE RAY TUBE WITH MAGNETIC POLE PIECES WHICH SUPPORT A RING GETTER

BACKGROUND OF THE INVENTION

1. Field of the Invention

The present invention generally relates to an improvement of a cathode ray tube apparatus having a cathode ray tube and a magnetic deflection means, and especially to a cathode ray tube apparatus for producing rectangle raster of very small distortion.

2. Description of the Prior Art

There are many kinds of deflection means to be applied for a cathode ray tube to deflect its electron beam; in a cathode ray tube apparatus using deflection means to form uniform magnetic field has a shortcoming that, though it has small deflection distortion, its raster is liable to have shape distortion, and thereby, raster distortion compensation permanent magnets are required. On the other hand, in another cathode ray tube apparatus using deflection means which forms deflection magnetic field of pin-cushion distribution of magnetic flux, though the apparatus can project accurately rectangle shaped raster without use of the compensation magnets, the apparatus has a large deflection distortion, and especially at the peripheral parts of the phosphor screen the electron beam spots are liable to have shape distortion, thereby making attainment of high resolution difficult.

SUMMARY OF THE INVENTION

The primary purpose of the present invention is to provide a cathode ray tube apparatus, which can provide satisfactory image having accurate rectangle raster with electron beam spots of good shape, even using deflection means for generating magnetic field of pin-cushion type flux distribution.

A cathode ray tube apparatus in accordance with the present invehtion comprises:

a cathode ray tube having at least an electron gun, a fluorescent screen and an evacuated envelope enclosing the electron gun and the fluorescent screen therein and magnetic deflection means for producing at least horizontal or vertical magnetic field of a pin-cushion type magnetic flux distribution, which further comprises:

a pair of magnetic pole pieces which are disposed to oppose each other with path of electron beam from the electron gun inbetween, at a part between front end having electoon beam outlet of the electron gun and center part of the deflection means, each of the magnetic pole pieces being substantially T-shaped having a central protrusion, which is disposed to oppose to the other central protrusion of the other pole piece with path of the electron beam inbetween.

DESCRIPTION OF THE PREFERRED EMBODIMENTS

Figure 1:
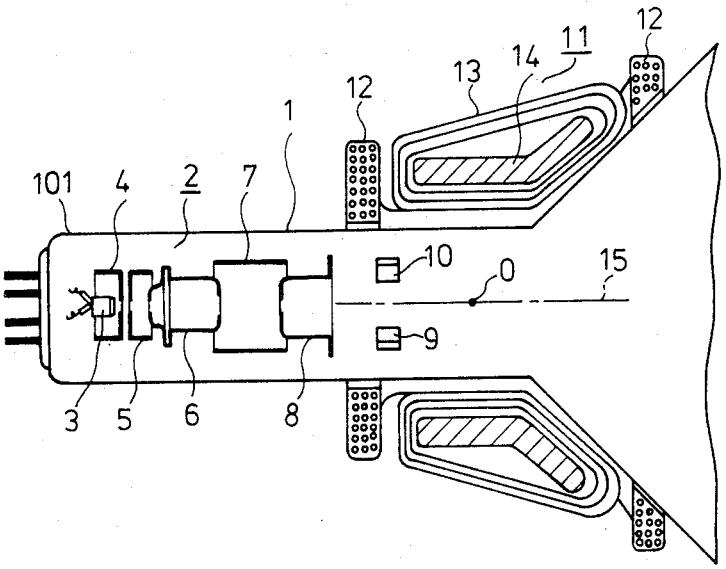
FIG. 1 is a schematic sectional view of a cathode ray tube apparatus embodying the present invention.

FIG. 1 is a schematic sectional view of the principal part of the cathode ray tube apparatus embodying the present invention. The embodiment is a monochrome type cathode ray tube apparatus which comprises a monochrome cathode ray tube 1 and deflection means 11. The cathode ray tube 1 has a unipotential type electron gun 2 which comprises a cathode 3, a first grid 4, a second grid 5, a third grid 6, a fourth grid 7 and a fifth grid 8, and furthermore a pair of pole pieces 9, 10 made of magnetic material, which are disposed at a position between the front end tip of the electron gun 2 and the center part of the deflection means 11, in a evacuated envelope 101 in a manner to have electron beam path which is generally on the longitudinal axis of the cathode ray tube 1 between the pair. The deflection means 11 comprises known horizontal deflection coil 12 and vertical deflection coil 13, and further a core 14. And the horizontal deflection coil 12 is constituted in a manner to form pin-cushion type horizontal deflection magnetic field, and the vertical deflection coil 13 also are constituted to form a pin-cushion type vertical deflection magnetic field. Some parts of magnetic field at the side of the front end of the electron gun 2 make a magnetic reaction to the magnetic pole pieces 9, 10.

Figure 2:
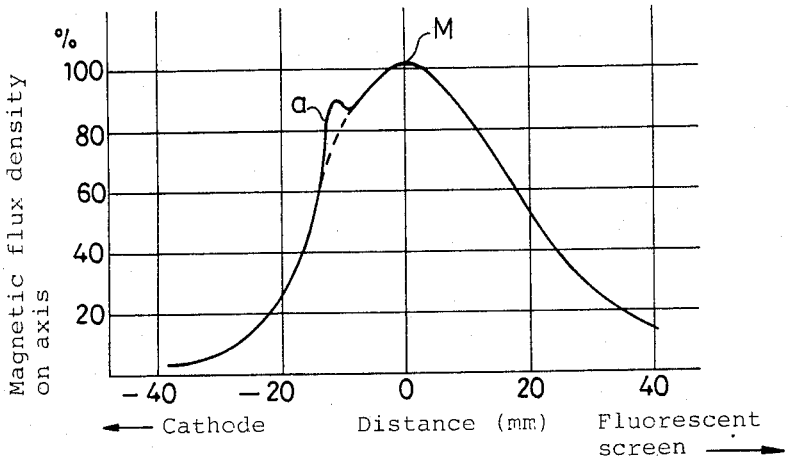
FIG. 2 is a graph showing magnetic flux distribution on axis of the cathode ray tube apparatus shown in FIG. 1.

FIG. 2 shows axial distribution of the magnetic flux density of the horizontal deflection magnetic field along the longitudinal axis 15 of the cathode ray tube 1, wherein from the axial position zero where the magnetic flux density is maximum the distribution slopes down towards both sides as the distance increases along the axis. As shown in FIG. 2, at the part a, the magnetic flux density is boosted by the effect of the magnetic pole pieces 9, 10, thereby to produce a small peak.

Figure 3:
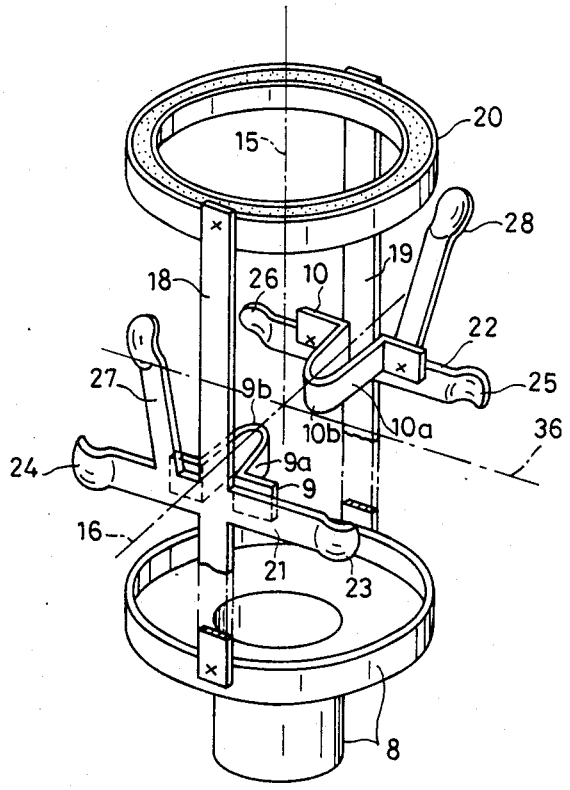
FIG. 3 is a perspective view of the essential part of the cathode ray tube apparatus of the apparatus of FIG. 1.

The magnetic pole pieces 9, 10 are configurated as shown in FIG. 3, in substantially T letter shape, with their protruded parts 9*a*, 10*a* to oppose each other on both sides of the electron beam path, which is substantially along the axis. The T-shaped magnetic pole pieces 9, 10 are made of ferro-nickel alloy (50% Fe—50% Ni), and the pole pieces 9, 10 are disposed on both sides of such a point on the cathode ray tube axis where a magnetic field of pin-cushion type magnetic flux distribution of some density exists.

The magnetic pole pieces 9, 10 are mounted on a non-magnetic metal holding members 18 and 19 which are fixed at their one side ends on extended peripheral part of the fifth grid 8, and their other ends support a ring getter 20. The holding members 18 and 19 have crossing members 21 and 22, respectively, which have abutting ends 23, 24 and 25, 26 for abutting on the inner wall of neck part of the evacuated envelope 101 with their spring action to correctly support the electron gun 2, and the cross-shaped members 21 and 22 further have obliquely extended contact members 27 and 28 for electrical contact with electrically conductive film provided on the inner wall of a cone part of the evacuated envelope 101 as known in the prior art.

Figure 4:
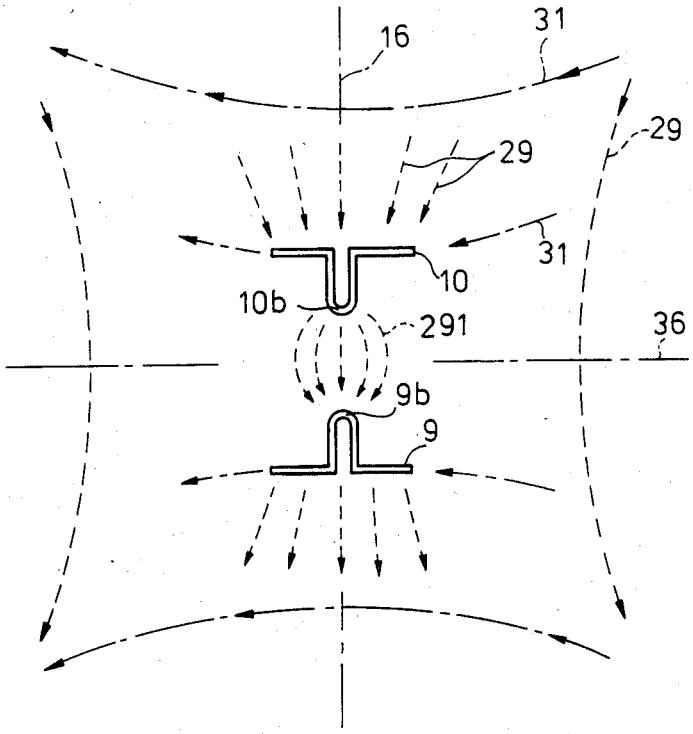
FIG. 4 is a chart showing magnetic flux distribution of the apparatus of FIG. 1.

As shown in FIG. 4, as a result of providing the T shaped magnetic pole pieces 9, 10 in a magnetic field of the pin-cushion type flux distribution of the horizontal deflection magnetic field 29, a magnetic field 291 of a barrel type is formed between the protrusions 9*b* and 10*b*, and the magnetic flux density between the magnetic pole pieces 9, 10 are boosted. On the other hand, magnetic fluxes 31 of the vertical deflection magnetic field simply passes through the magnetic pole pieces 9, 10 in their longitudinal direction. Accordingly, horizontal deflection magnetic field is formed in a manner that at the part of their maximum flux density and towards the screen, the flux distribution becomes pin-cushion type. And on the other hand at the part of the side nearer to the front end of the electron gun 2 where the magnetic flux distribution is not so effective to the resultant raster shape the magnetic field is formed to have barrel type flux distribution, thereby a rectangle raster of small distortion is obtainable, and also deflection distortion is decreased. Accordingly, the electron beam spots at vertical peripheral parts of the phosphor screen are improved substantially circular, thereby improving the resolution.

The position of the magnetic pole pieces 9, 10 with respect to the direction of the longitudinal axis of the cathode ray tube 1 has close relation with the magnetic flux distribution of the deflection magnetic fields, and the position of the magnetic pole pieces 9, 10 should be on the axial position, where the magnetic flux density on the axis of the cathode ray tube is 20–80% of the peak value of the axial magnetic flux density, and in the side between the front end i.e., electron beam outlet end, of the electron gun 2 and the part of maximum axial magnetic flux density distribution.

Figure 5:
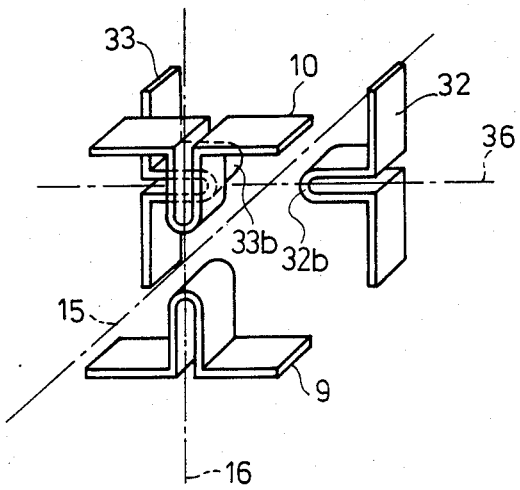
FIG. 5 is a perspective view of an essential part of another embodiment.
Figure 7:
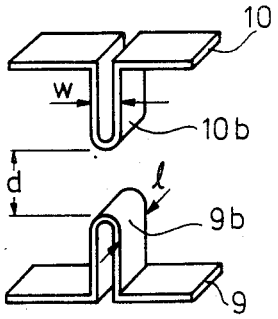
FIG. 7 is a perspective view showing sides of magnetic pole pieces of the embodiment.

Since the raster has a rectangle shape having longer size in the horizontal direction, the improvement of resolution at the peripheral parts near the vertical side lines of the raster is very effective for attaining high quality picture reproduction. When further improvement of resolution at the peripheral area near the upper and lower edge lines of the raster is intended, further pair of magnetic pole pieces 32, 33 is provided as shown in FIG. 5, in a manner that the protrusions 32*b* and 33*b* of the magnetic pole pieces 32, 33 of the seoond pair is disposed in the horizontal direction substantially on the horizontal axis 36.

Figure 6:
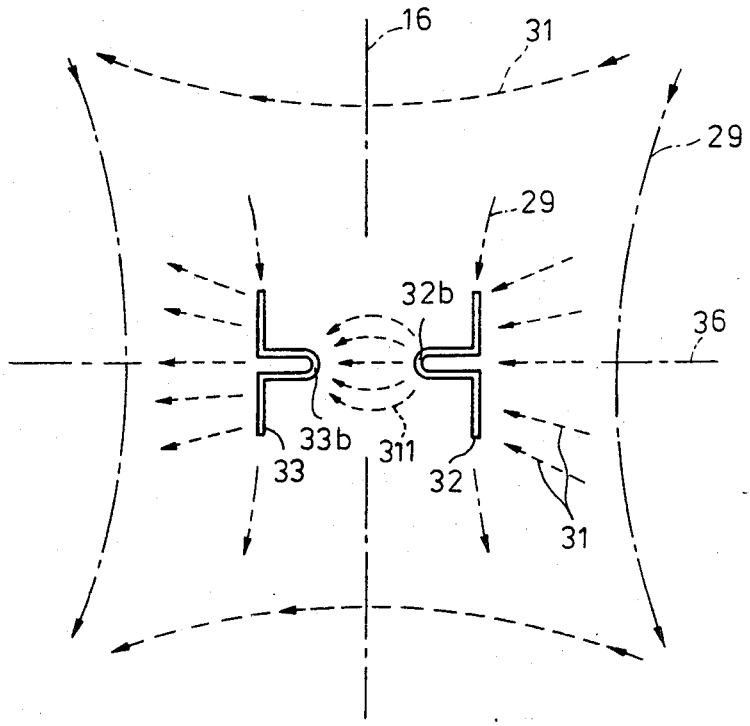
FIG. 6 is a chart showing magnetic flux distribution of the apparatus of FIG. 5.

The above-mentioned embodiment is described for the cathode ray tube apparatus having the deflection means wherein horizontal deflection magnetic field and vertical deflection magnetic field both have pin-cushion type magnetic flux distributions. But the present invention is of course applicable for such case that the horizontal deflection magnetic field has substantially uniform magnetic flux distribution and only the vertical deflection magnetic field has pin-cushion type magnetic flux distribution. In the latter case, instead of disposing the magnetic pole pieces 9, 10 in the vertical direction, magnetic pole pieces 32 and 33 should be disposed in the horizontal direction as shown in FIG. 6.

The optimum axial length of the magnetic pole pieces 9, 10 or 32, 33 are dependent on their axial disposition in the cathode ray tube. For example, in a monochrome 90°-deflection type cathode ray tube of 12 inch diagonal size, which has about 20 mm diameter of neck part, when the width W of the protrusions 9*b* and 10*b* are 7 mm and gap d between in the end tips of the protrusions 9*b* and 10*b* is about 6 mm, the optimum axial length l of the magnetic pole pieces 9, 10 and/or 32, 33 is 3 mm when the dispositions of the magnetic pole pieces 9, 10 and/or 32, 33 is at the part of 70% magnetic flux density to the maximum magnetic flux density, and about 6 mm when the dispositions is at the part of 50% magnetic flux density, and about 9 mm at the part of 30% magnetic flux density, respectively.

As described above on the preferred embodiments, the present invention can provide accurately rectangle shape raster with high resolution to the peripheral parts of the fluorescent screen by providing the magnetic pole pieces 9, 10 and/or 32, 33 between the front end part of the electron gun 2 and the center part of the deflection member 11.

What is claimed is:

1. A monochrome type cathode ray tube apparatus having a single-beam gun, comprising:

a cathode ray tube having an electron gun, a fluorescent screen and an evacuated envelope enclosing said electron gun and said fluorescent screen therein; magnetic deflection means for producing at least a horizontal and a vertical magnetic field having a pin-cushion type magnetic flux distribution;

a pair of pole pieces disposed to oppose one another with the path of an electron beam from said electron gun inbetween for compensating distortion of deflection, said pole pieces being between the electron beam outlet of said electron gun, and a center part of said deflection means, each of said magnetic pole pieces being substantially T-shaped and each having a central protrusion disposed in an opposed relationship to the central protrusion of the other pole piece with said path of said electron beam inbetween, said magnetic pole pieces being secured in position with respect to one another and with respect to said cathode ray tube by holding members of non-magnetic metal, said holding members being secured at one end to the front end of said electrode gun and being secured at the other ends thereof to a ring getter to thereby form a fixed frame for supporting said pole pieces.

2. A cathode ray tube apparatus in accordance with claim 1 further comprising means for maintaining the distance between the deflection means and said magnetic pole pieces constant, said means including said holding members each having cross members having end tips which abut the inside wall of a neck portion of said evacuated envelope to thereby fix the relative position of the pole pieces in said envelope.

3. A monochrome type cathode ray tube apparatus having a single-beam gun, comprising:

a cathode ray tube having an electron gun, a fluorescent screen and an evacuated envelope enclosing said electron gun and said fluorescent screen therein; magnetic deflection means for producing at least a horizontal and a vertical magnetic field having a pin-cushion type magnetic flux distribution;

a pair of magnetic pole pieces disposed to oppose each other with the path of an electron beam from said electron gun inbetween for compensating distortion of deflection, said pole pieces being between the electron beam outlet of said electron gun and a center part of said deflection means, each of said magnetic pole pieces being substantially T-shaped and each having a central protrusion disposed in an opposed relationship to the central protrusion of the other pole piece with said path of said electron beam inbetween; and said magnetic pole pieces being held by holding members of non-magnetic metal, each having a rear-ends which are fixed to the front end of said electron gun and each having front ends which hold a ring getter, said holding members each being elongated in a tubular axis direction.

* * * * *